US007998274B2

(12) United States Patent
Rodrigues et al.

(10) Patent No.: US 7,998,274 B2
(45) Date of Patent: Aug. 16, 2011

(54) SMOKING ARTICLE

(75) Inventors: Antonio Augusto Da Silva Rodrigues, Rio de Janeiro (BR); Nadia Maria de Almeida Rodrigues, legal representative, Rio de Janeiro (BR); Eduardo José Faria Miranda, Rio de Janeiro (BR)

(73) Assignee: Souza Cruz S.A., Rio de Janeiro (BR)

( * ) Notice: Subject to any disclaimer, the term of this patent is extended or adjusted under 35 U.S.C. 154(b) by 924 days.

(21) Appl. No.: 10/581,774

(22) PCT Filed: Dec. 10, 2004

(86) PCT No.: PCT/IB2004/004350

§ 371 (c)(1),
(2), (4) Date: Mar. 14, 2007

(87) PCT Pub. No.: WO2005/058078

PCT Pub. Date: Jun. 30, 2005

(65) Prior Publication Data

US 2008/0163879 A1 Jul. 10, 2008

(30) Foreign Application Priority Data

Dec. 11, 2003 (GB) ..... 0328644.0

(51) Int. Cl.
*A24B 3/14* (2006.01)
*A24B 15/12* (2006.01)
*A24B 15/30* (2006.01)

(52) U.S. Cl. ..... 131/275; 131/360; 131/364; 131/365

(58) Field of Classification Search ..... 131/275
See application file for complete search history.

(56) References Cited

U.S. PATENT DOCUMENTS

| | | | | | |
|---|---|---|---|---|---|
| 4,526,183 | A * | 7/1985 | Nichols et al. | ..... | 131/336 |
| 4,587,982 | A * | 5/1986 | Adams et al. | ..... | 131/336 |
| 4,595,024 | A * | 6/1986 | Greene et al. | ..... | 131/77 |
| 4,759,380 | A * | 7/1988 | Norman et al. | ..... | 131/364 |
| 4,785,833 | A * | 11/1988 | Holzner et al. | ..... | 131/310 |
| 4,924,883 | A * | 5/1990 | Perfetti et al. | ..... | 131/336 |
| 5,137,036 | A * | 8/1992 | Southwick | ..... | 131/277 |
| 6,475,288 | B1 * | 11/2002 | Oliver | ..... | 131/274 |
| 2005/0039767 | A1 * | 2/2005 | Mua et al. | ..... | 131/370 |

FOREIGN PATENT DOCUMENTS

| | | | |
|---|---|---|---|
| CA | 2338831 | A1 | 8/2002 |
| DE | 4435110 | A1 | 4/1996 |
| GB | 1284151 | A | 8/1972 |
| WO | 0128368 | A | 4/2001 |
| WO | WO 0128368 | A1 * | 4/2001 |

* cited by examiner

*Primary Examiner* — Philip C Tucker
*Assistant Examiner* — Vicki Wu
(74) *Attorney, Agent, or Firm* — Charles I. Sherman; Middleton Reutlinger

(57) ABSTRACT

A smoking article comprising discrete segments of smokable material having an encapsulated flavourant contained within a component of the smokable material to provide a stable release of flavourant at different points during smoking, and in particular in the final puffs. The encapsulated flavourant is incorporated within a reconstituted tobacco material for ease of manufacture and for improved flavour stabilisation. A method of making a segmented smoking article having encapsulated flavourant therein is also provided.

36 Claims, 4 Drawing Sheets

SMOKING ARTICLE

CROSS REFERENCE TO PRIOR APPLICATION

This application is a national stage filing (35 U.S.C. 371) of PCT/IB2004/004350, filed on Dec. 10, 2004 which claims priority to and benefit from Great Britain Patent Application No. 0328644.0, filed on Dec. 11, 2003, currently pending.

BACKGROUND OF THE INVENTION

Field of the Invention

This invention relates to smoking articles, and in particular to the location of flavourant in a smoking article, such as a cigarette.

The application of flavourant materials to smoking articles to effect a modification of the smoke characteristics thereof has long been a desirable aim. Flavourant materials have been added to smoking articles in various forms, for example, by spraying a flavourant-containing solution onto tobacco or by applying flavourant material to the cigarette wrapper. However, due to the volatile or semi-volatile nature of many flavourant materials a substantial amount of the flavourant material is lost via evaporation during the manufacture and storage of the smoking articles. This makes accurate positioning of flavourant in a cigarette extremely difficult. Further problems may be encountered upon smoking, during which smoke drawn along the smoking article volatilises the flavourant material throughout the smoking article, resulting in the consumer perceiving an uneven distribution of the flavourant in the smoking article. In order to prevent loss or premature volatilisation of the flavourant material various substances have been utilised to encapsulate the flavourant material.

Microencapsulation of flavour has been suggested in GB 2 078 487 which describes a smoking article having a smoke-modifying agent therein. The concentration of the smoke-modifying agent is greater at one, or each, end of the fuel rod of the smoking article. In particular the concentration of smoke-modifying agent is greater at the lighting end of the smoking article. The difference in concentration of smoke-modifying agent within the fuel rod is achieved by passing an air stream through the fuel rod and entraining the smoke-modifying agent in the air stream so that the agent may pass some way along the fuel rod. Each end or only one end of the fuel rod of the smoking article may be treated accordingly. A problem associated with this invention is that the microcapsules of smoke-modifying agent are only blown onto the formed tobacco rod, therefore the particles can drop out of the tobacco rod. It is also difficult to accurately position the microcapsules and obtain a distinct change between a portion of the smoking article without smoke-modifying agent therein and a portion having the agent therein.

Efforts have been made to produce segments comprising different compositions, the segments being positioned one behind another along the length of a smoking article. GB 1 443 402 describes a cigarette comprising at least three individually-wrapped segments surrounded by an outer wrap. Each segment comprises a different blend of tobacco and tobacco substitute material, such as shredded carbon filled paper, with segments at the mouthpiece end of the cigarette containing the greatest amount of tobacco substitute. Smoke constituent yields obtained during smoking are more consistently distributed in comparison to a conventional cigarette not being comprised of segments.

A cigarette having a filling of two axially arranged cartridges each containing a different quality of tobacco material is described in EP 0 468 298. The individually wrapped cartridges are surrounded by an outer wrapper. In one embodiment flavour-affecting panels or discs are arranged perpendicular to the longitudinal axis of the cigarette between adjoining faces of the tobacco-containing cartridges. Thus not only is a different smoke quality achieved between segments but a different flavour occurs at the 'changeover' position from one tobacco type to another.

These documents do not provide a means by which a stabilised flavourant may be accurately positioned.

It is an object of the present invention to provide a rod of smokable material that gives different flavour characteristics to the consumer between initial and final puffs when smoked.

This invention also has as an object the provision of simple processes by which a rod of smokable material comprising more than one segment may be produced.

It is a further object of the present invention to provide a stabilised flavourant to allow accurate release of flavourant to a consumer during smoking, and in particular in the final puffs of the smoking article.

SUMMARY OF THE INVENTION

The present invention provides a smoking article comprising a rod of smokable material wrapped in a wrapper, the rod comprising two discrete segments in substantially end-to-end abutment, one of the segments comprising an encapsulated flavourant incorporated within a component of the smokable material.

There is further provided a method of producing a smoking article comprising a rod of smokable material wrapped in a wrapper according to the present invention, the method comprising joining the at least two discrete segments in substantially end-to-end abutment of the rod with a wrapper.

Suitably the rod of smokable material may comprise more than two discrete segments, and may comprise three, four or more discrete segments. Most preferably the rod of smokable material comprises only two segments.

Preferably at least one segment is of a substantially cylindrical shape. Advantageously at least two segments are of substantially cylindrical shape.

Preferably the or a segment located towards the mouth end of the smoking article comprises flavourant. It is preferred that only the segment at the mouth end of the smoking article contains encapsulated flavourant therein. Suitably the flavourant may be volatile or semi-volatile. The flavourant may be in liquid or solid form, for example in droplet, granule or powder form.

Any flavourant may be incorporated into the rod of smokable material of the present invention to achieve the desired sensorial characteristics. Suitable flavourants may include, for example, menthol, cocoa, *Mentha arvensis*, vanillin, ethylvanillin, ethyl vanillin glycoside, ionones, damascenone, $C_9$ to $C_{12}$ lactones.

Preferably flavourant is encapsulated in a polysaccharide, for example an alginate, such as sodium alginate or calcium alginate, a starch, a cyclodextrin, for example β-cyclodextrin, or an adsorbent, such as carbon. Preferably the adsorbent is in granular or powder form. Suitably the carbon is activated carbon.

Known processes can be used to provide such encapsulated material. Preferably flavourant is encapsulated using a process of extrusion. Preferably the encapsulated flavourant is in any one or more of the following forms: capsule, strip, filament or thread. Processes such as that described in WO 00/08958 are suitable flavourant extrusion processes, and that described in WO 00/08959 is a suitable method of incorporating a flavourant-containing filament in a smoking article. The contents of both documents are incorporated herein by reference thereto.

Preferably, an inert material, for example a carbonate, may be applied onto the encapsulated flavourant to reduce particulate matter delivered to the consumer during smoking of the smoking article of the present invention. Suitably, the inert material does not combust and reduces the amount of material that burns in the smoking article during smoking. Alternatively, inert flavourant may be included in reconstituted or tobacco substitute material.

Preferably a segment of the rod of smokable material comprises cut tobacco material. Even more preferably two or more segments comprise cut tobacco material. Advantageously the tobacco material comprises 0-100% flue-cured tobacco and/or 0-100% U.S. blend tobacco. Preferably the tobacco material comprises a U.S. blend, which blend comprises 40-50% flue-cured tobacco, 10-20% Burley tobacco, 5-15% Oriental tobacco, 10-30% reconstituted tobacco material and 10-30% stem material.

Advantageously a segment of the rod of smokable material comprises reconstituted tobacco material. It is much by preference that the encapsulated flavourant is incorporated within the reconstituted tobacco material. This provides further stabilisation of the flavourant and allows the encapsulated flavourant to be more securely and accurately positioned within the smokable material, and particularly within a segment of the final smoking article. Reconstituted tobacco material may constitute 0-100% of the smokable material of a segment, but preferably constitutes 20-50%. Preferably the reconstituted tobacco material comprises tobacco dust, which tobacco dust is preferably included in the range 30-70% of the reconstituted tobacco material, and even more preferably in the range 50-70%. Preferably the reconstituted tobacco material is formed by an extrusion process. Preferably the reconstituted tobacco material is produced in the form of a sheet or filament. Preferably the reconstituted tobacco material is produced by a process known as DEER (Directly Expanded Extruded Reconstituted) or by a process to produce extruded filament. The extrusion process involves the provision of a mixture of particulate tobacco, starch and binder, with the addition of water and humectants, the mixture being extruded to form a sheet or filament extrudate. The conditions of extrusion result in the extrudate having a greater cross-section than the exit orifice of the extruder. The extrudate is drawn down to reduce the thickness thereof and is subsequently cut to provide a product of suitable size for use in a smoking article. The DEER process is described in GB-A-2 201 080 and GB-A-2 201 081 and an Extruded Filament process is described in WO 01/84968, the contents of which documents are included herein by reference thereto. Advantageously, a segment may comprise a different blend of smokable material, whether comprising tobacco material or not, from a further segment.

Preferably flavourant is included in the rod of smokable material in an amount of 200 to 50,000 ppm (parts per million), and is more preferably included in an amount of 5000 to 10,000 ppm.

Preferably the rod of smokable material further comprises a filter element, the filter element being located at the mouth end of the rod of smokable material. The filter is preferably a conventional cellulose acetate filter, but may be any other filter well-known in the art, such as a paper or tobacco filter. Further, the filter may be a multiple filter comprising two or more filter elements arranged in longitudinal alignment which may suitably form a dual or triple filter. Filters suitable for use in the present invention include a coaxial filter element and/or a filter element containing carbon, wherein the carbon is preferably activated carbon, and/or wherein the carbon is preferably in granular form.

Preferably a segment of the rod of smokable material of the present invention is individually circumscribed by a wrapper, and advantageously each segment is individually circumscribed by a wrapper. This greatly improves the handling of the segments and allows construction of the smoking article with minimal loss of smokable material from the segments. Two segments may suitably be joined together by a wrapper circumscribing a point at which adjacent ends of the two segments abut, the wrapper thereby circumscribing at least a part of each of the two segments to be joined. The wrapper joining the two segments may extend over the entire length of the rod of smokable material.

A filter may be attached to a segment by a wrapper circumscribing at least part of the filter and at least part of the segment to be joined to the filter, that is the wrapper circumscribes a point at which adjacent ends of the filter and the segment to which the filter is to be joined abut. A wrapper for use in circumscribing a segment and/or a filter of the rod of smokable material of the present invention includes a conventional cigarette paper wrapper, a tipping wrapper, a pretipping wrapper, a plugwrap and any other wrapper well known to those skilled in the art. Suitably the wrapper may be coloured or colourless and is preferably coloured. A coloured wrapper may be suitable to indicate to the consumer the point at which the taste and aroma characteristics of the smoking article will be modified when being smoked. A wrapper preferably has a permeability of 10-70 CORESTA Units (CU), and even more preferably a permeability of 50-70 CU.

A wrapper may be ventilated or unventilated. When the rod of smokable material of the present invention comprises a filter, preferably the filter is attached to a first segment at the mouth end of the rod of smokable material by a tipping wrapper or a pretipping wrapper, and may suitably be attached to a further or second segment by a tipping wrapper.

Preferably an adhesive is used to secure a wrapper circumscribing a segment and/or a filter of the rod of smokable material. The adhesive is preferably a conventional adhesive used in the art of manufacturing rods of smokable material, and preferably comprises polyvinyl acetate (PVA). Advantageously the adhesive comprises a flavourant, which flavourant is preferably encapsulated. The flavourant in the adhesive masks the potential off-taste produced by the adhesive upon smoking.

Preferably the length of a segment is 10-90% of the total length of the rod of smokable material. More preferably the length of a segment is 40-60% of the total length of the rod of smokable material.

BRIEF DESCRIPTION OF THE DRAWINGS

In order that the subject invention may be easily understood and readily carried into effect, reference will now be made, by way of example, to the accompanying drawings, in which.

DETAILED DESCRIPTION OF THE PREFERRED EMBODIMENTS

Figure 1:
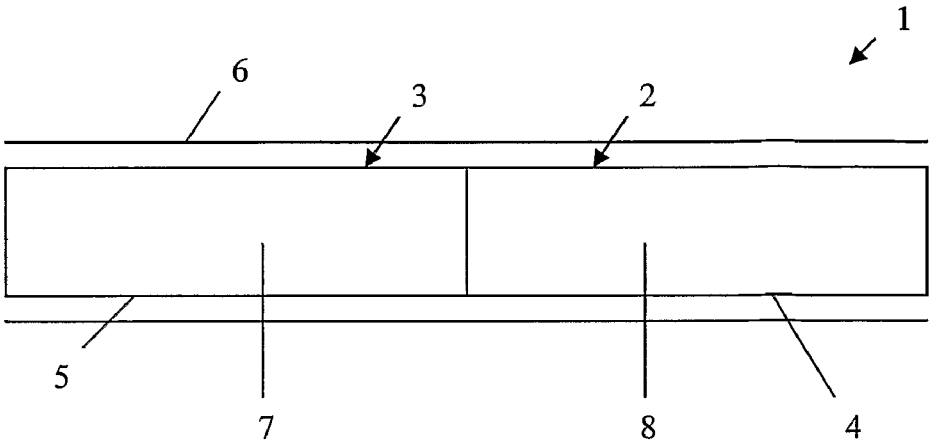
FIG. 1 shows a cross-sectional view of a rod of smokable material according to the invention.

The rod of smokable material (1) of FIG. 1 comprises a discrete first segment (2) arranged in a longitudinal orientation in relation to a discrete second segment (3), such that first segment (2) is located behind second segment (3) along the longitudinal axis of the rod of smokable material. The first segment (2) comprises smokable material (8) having encapsulated flavourant therein. The encapsulated flavourant is incorporated in the smokable material, i.e. occurs as a component of the smokable material, or, alternatively, may be a self-sustaining element, such as a thread comprising flavourant encapsulated in an alginate, for example. The first segment (2) and the second segment (3) are each circumscribed by a wrapper (4, 5). When in longitudinal abutment an outer wrapper (6) circumscribes first and second segments (2, 3) and serves to attach the first segment (2) to the second segment (3) in a longitudinally abutting end-to-end arrangement. This arrangement produces a double wrapper over the length of smokable material.

During smoking, the rod of smokable material (1) is lit at one end, such as an end of the second segment (3) furthest from the first segment (2). Smoke from the lit end of the rod of smokable material (1) is drawn along the rod through the second segment (3) and subsequently through the first segment (2) to the consumer. As smoke passes through the first segment (2), which segment comprises encapsulated flavourant therein, no flavourant is released into the smoke. The temperature of the smoke is insufficient to release from the encapsulating material the flavourant contained therein. Resultantly, the consumer receives smoke having only taste and sensorial characteristics associated with the smoking material (7) of the second segment (3). As the rod of smokable material (1) is smoked the burning coal advances towards the mouth end of the rod. As the burning coal comes into contact with the encapsulated flavourant of the first segment (2) flavourant is released from the encapsulating material and is drawn, together with smoke, to the mouth end of the rod of smokable material, providing the consumer with modified sensorial characteristics.

Figure 2:
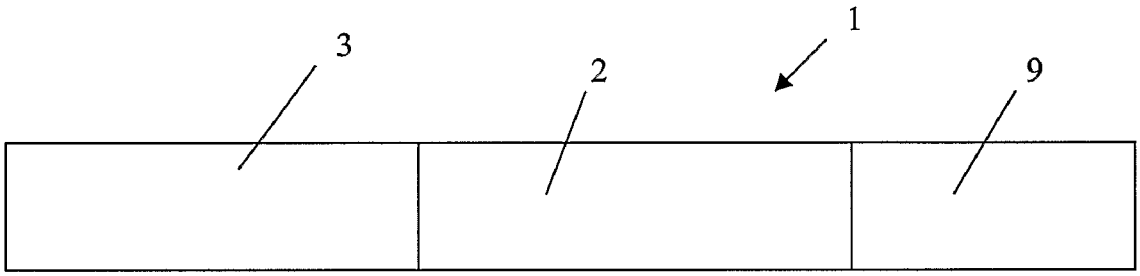
FIG. 2 shows a cross-sectional view of a rod of smokable material according to the invention comprising a filter.

FIG. 2 shows the smokable rod of FIG. 1 with a filter element (9) in longitudinal abutment therewith. The first segment (2) comprises a flavourant therein.

Figure 3:
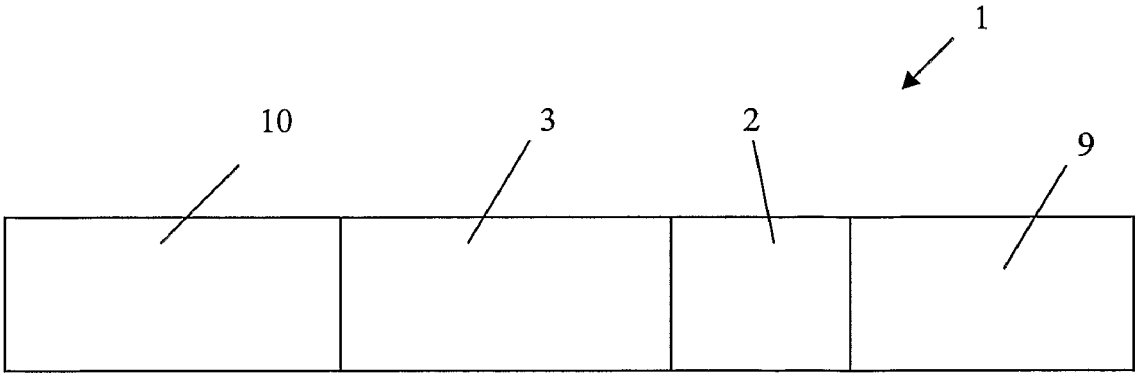
FIG. 3 shows a cross-sectional view of a further embodiment of the invention.

A further embodiment of the invention is shown in FIG. 3 in which a rod of smokable material (1) comprises a first segment (2), a second segment (3), and a third segment (10). The third segment (10) is located at the lighting end of the second segment (3), in longitudinal abutment therewith. A filter element (9) is attached to the mouth end of the first segment (2), the mouth end being the end of the first segment (2) furthest from the second segment (3). The first segment (2) comprises encapsulated flavourant therein to provide modified sensorial characteristics to the consumer upon smoking.

Figure 4:
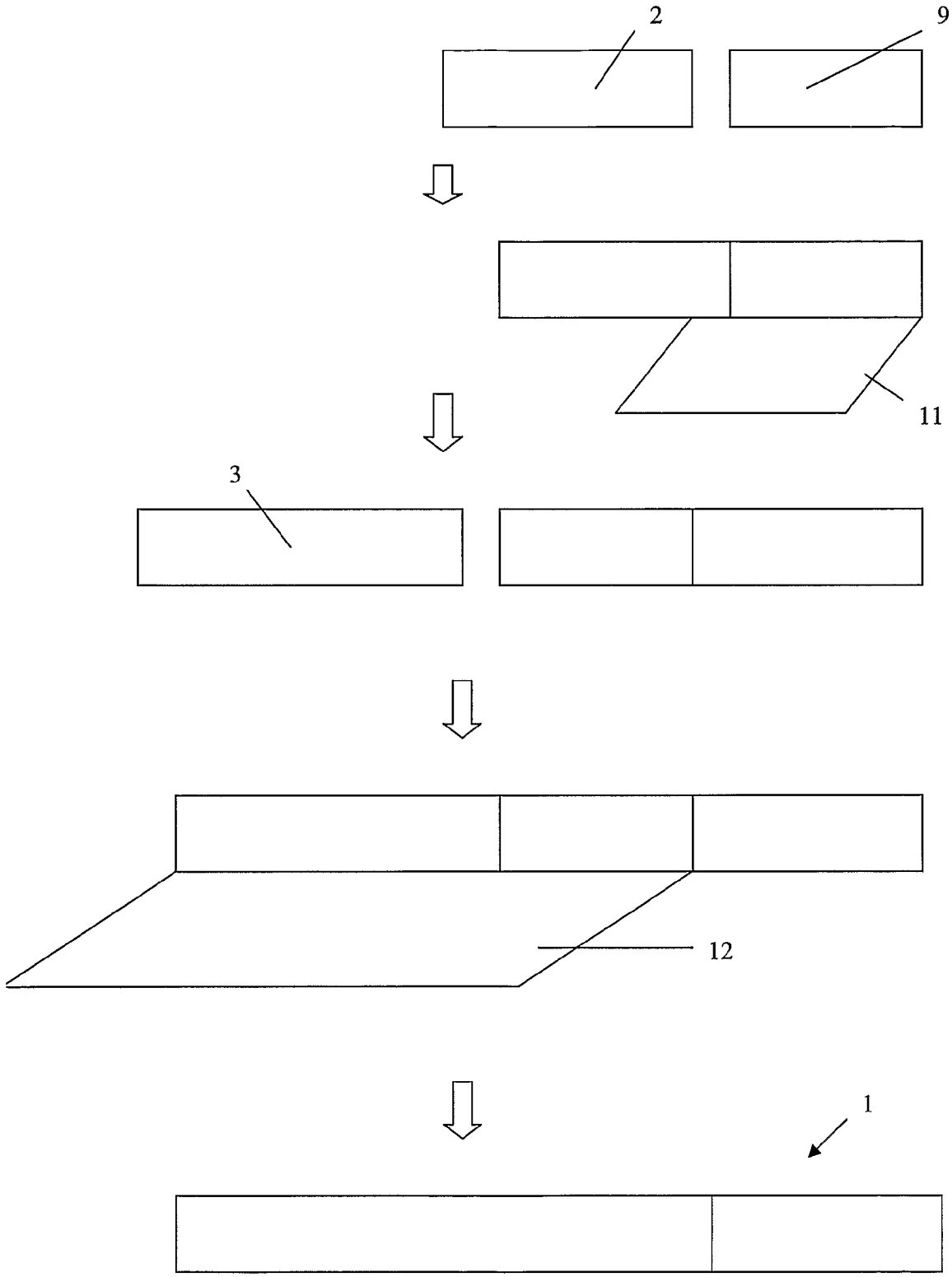
FIG. 4 shows a cross-sectional view of the steps of construction of an embodiment of the invention.

FIG. 4 shows an aspect of construction of the rod of smokable material of the invention, in which the attachment means of the segments and a filter are clearly demonstrated. A first segment (2) is attached to a filter element (9) by circumscribing the filter element (9) and part of the segment (2) with a tipping wrapper (11). A second segment (3) is then attached in longitudinal abutment to the first segment (2) by circumscribing the first and second segments (2, 3) with a wrapper (12). The wrapper (12) extends from the lighting end of the second segment (3), being the end furthest from the filter element (9), to the point at which the tipping wrapper (11) extends along the first segment (2). In the final rod of smokable material (1) the first and second segments (2, 3) are not visible to the consumer.

Figure 5:
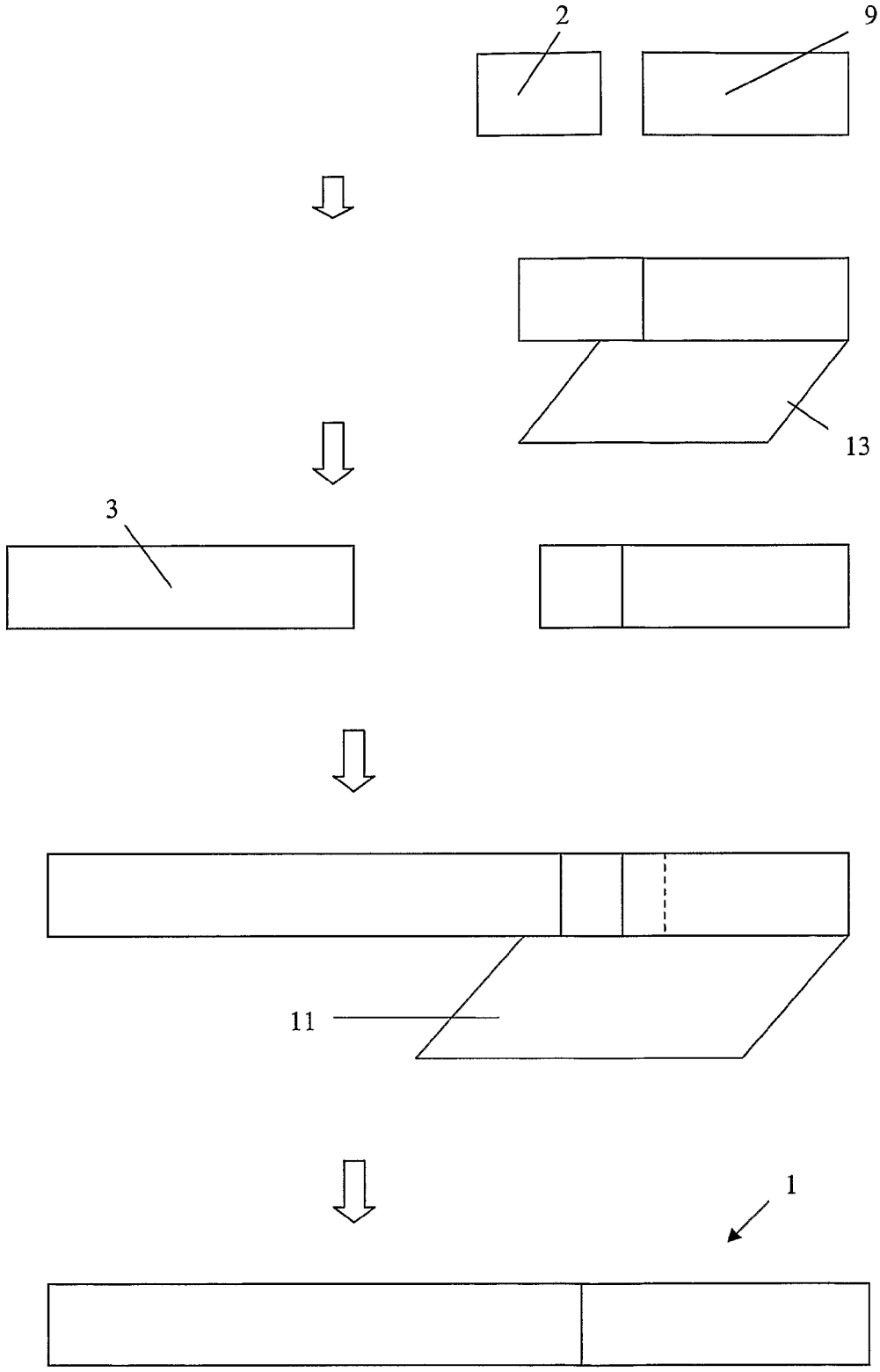
FIG. 5 shows a cross-sectional view of the steps of construction of an embodiment of the invention.

An alternative means of constructing a rod of smokable material according to the invention is shown in FIG. 5. A first segment (2) is attached to a filter element (9) by means of a pretipping wrapper (13), in which the pretipping wrapper (13) circumscribes the first segment (2) and the filter element (9). A second segment (3) is subsequently attached in longitudinal abutment to the end of the first segment (2) furthest from the filter element (9) by means of a tipping wrapper (11). The tipping wrapper (11) circumscribes the filter element (9), the first segment (2) and the second segment (3). The tipping wrapper (11) circumscribes only a part of the second segment (3), which part is towards the end at which the second segment (3) abuts the first segment (2). The tipping wrapper (11) serves to secure the second segment (3) in place in longitudinal relationship to the first segment (2) and the filter element (9).

Figure 6:
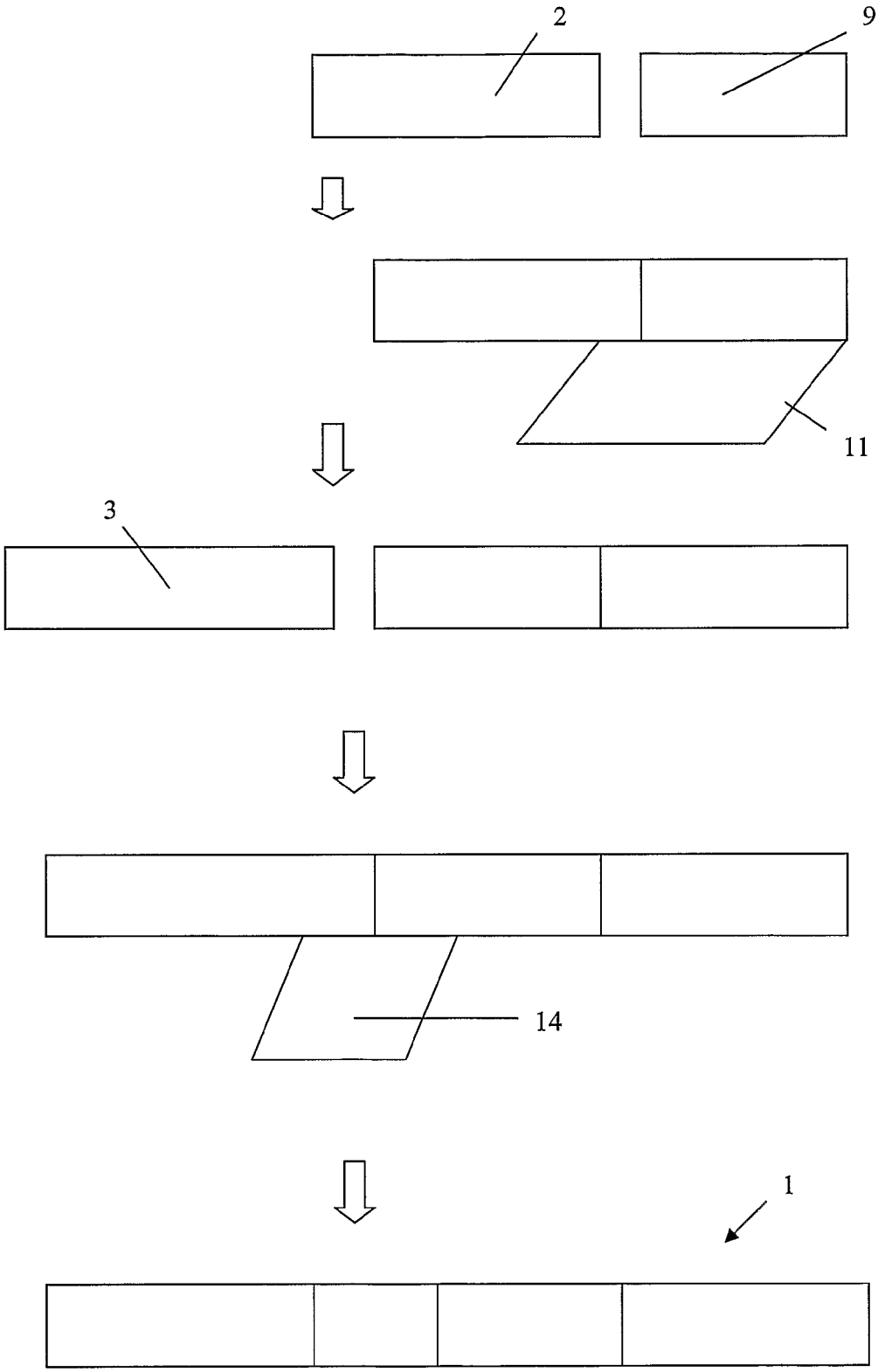
FIG. 6 shows a cross-sectional view of the steps of construction of a further embodiment of the invention.

A further embodiment is shown in FIG. 6. A filter element (9) is attached to a first segment (2) by means of a tipping wrapper (11), which tipping wrapper (11) circumscribes the filter element (9) and the first segment (2). The tipping wrapper (11) does not extend over the entire length of the first segment (2). The combination of the filter element (9) and the first segment (2) is then attached to a second segment (3) by means of a wrapper (14). One end of the second segment (3) abuts the first segment (2) at an end furthest from the filter element (9). The wrapper (14) comprises a thin strip of paper and circumscribes the first segment (2) and the second segment (3). This method of wrapping is known as 'ring tipping'. The wrapper (14) extends over only a part of the length of the first segment (2) and the second segment (3). In the final rod of smokable material (1) the segments are visible to the consumer. The wrapper (14) may be coloured to indicate the point along the length of the rod of smokable material at which the sensorial characteristics will be modified when smoked.

There will now be described a number of examples:

Example 1

Powdered menthol was mixed with starch in an amount of 10% menthol in the mixture. The starch/menthol mixture was extruded, ground and mixed with tobacco dust, before being subjected to a further extrusion process. The extrusion process was carried out at a temperature of 135° C. and at a pressure of 1000 psi according to the DEER process in an APV Baker to obtain a reconstituted tobacco sheet. This reconstituted tobacco sheet was mixed with a US type tobacco blend, which blend comprises Virginia flue-cured tobacco, Burley tobacco, Oriental tobacco and reconstituted tobacco. The proportion of each type of tobacco in the US type tobacco blend is as follows: 53% Virginia flue-cured tobacco, 22% Burley tobacco, 5% Oriental tobacco and 20% reconstituted tobacco. The reconstituted tobacco sheet containing the menthol comprised 20% of the total mixture. This blend was used to produce a first segment circumscribed by a cigarette paper having a porosity of 50 CU, which segment was coupled to a 25 mm long cellulose acetate filter. The same US type tobacco blend, as was mixed with the reconstituted tobacco above, was used to manufacture a second segment of a rod of smokable material. This segment was then coupled to the first segment comprising the reconstituted tobacco sheet having encapsulated flavourant incorporated therein by means of a wrapper having a permeability of 50 CORESTA units (CU) on a LABMAX machine.

Example 2

Menthol encapsulated in β-cyclodextrin by molecular encapsulation was obtained from a product supplied by Mane. The encapsulated menthol was mixed with tobacco dust in an amount of 20% encapsulated menthol. The mixture was subjected to an extrusion process, which process was carried out according to the DEER process at a temperature of 135° C. and a pressure of 1000 psi in an APV Baker and a reconstituted tobacco sheet was obtained. The reconstituted tobacco was mixed with a US type tobacco blend, as was used in Example 1, in an amount of 50% reconstituted tobacco. The blend was used in the manufacture of a first segment of smokable material, which segment was coupled to a 25 mm long cellulose acetate filter by a conventional process to connect a filter to the cigarette rod. A second segment was produced using a US type tobacco blend as used in the mixture with the reconstituted tobacco above, and was coupled to the first segment by means of a wrapper having a permeability of 50 CU on a LABMAX machine.

Example 3

*Mentha arvensis* powder was mixed with tobacco dust, the *Mentha arvensis* powder constituting 20% of the mix. The mix was then subjected to an extrusion process according to the DEER process at a temperature of 150° C. at a pressure of 1000 psi in an APV Baker and a reconstituted tobacco sheet produced. The reconstituted tobacco was mixed with a US type tobacco blend of the same composition as used in Example 1 in an amount of 20% reconstituted tobacco. A first segment was made from the blend and was coupled to a 25 mm section of cellulose acetate filter. A second segment, comprising a US type tobacco blend, as previously used in Examples 1 and 2 above, mixed with the reconstituted tobacco, was made. This second segment had a length of 29 mm and a wrapper having a permeability of 50 CU and was attached to the first segment on a LABMAX machine. A wrapper having a permeability of 50 CU was used to join the segments.

Example 4

A mixture comprising a solution of sodium alginate and menthol was prepared. The alginate solution comprised a mixture of low molecular weight and high molecular weight alginates in a ratio of 3:1. The alginate solution is made as a 6% solution, having 4.5% low molecular weight alginate and 1.5% high molecular weight alginate. A menthol solution was prepared by dissolving a mixture of 70% Brazilian and 30% synthetic menthol in propylene glycol to form an 80% menthol solution. The menthol solution was then added to the alginate solution in a 1:1 ratio of menthol to alginate. The resultant menthol-alginate mixture was heated to a temperature of 45° C. and was fed through a nozzle of an extruder. The extrudate issuing from the nozzle was fed into a bath of calcium chloride dissolved in water (6% calcium chloride solution) to effect solidification of the mixture. The water soluble sodium alginate is converted in the calcium chloride bath to water insoluble calcium alginate which serves to encapsulate the menthol. The thread was allowed to set for 90 seconds prior to being wound onto a drum and allowed to dry at room temperature and relative humidity. The drum maintains the tension of the thread whilst drying. The thread was cut to the desired length of 3 cm sections.

Threads of encapsulated menthol were added to a US type tobacco blend in a proportion of 1.5% encapsulated menthol. A segmented smoking article was assembled using a portable cigarette maker machine. A first segment was prepared using 0.4 g of tobacco blend and two 3 cm lengths of menthol-alginate threads in a position relating to the filter end of the cigarette. The threads ran parallel to the longitudinal axis of the cigarette and were positioned, as far as possible, in the radial centre of the segment. A second segment was prepared at a position of the cigarette maker machine corresponding to the lighting end of the cigarette, which segment contained 0.4 g of tobacco blend. First and second segments were inserted into a cigarette tube.

A number of samples have been produced according to the methods described herein in examples 1 to 4, utilising varying amounts of flavourant and tobacco in the first segment of the rod of smokable material. Table 1 shows the compositions of the samples.

TABLE 1

| Sample | Second Segment | First Segment (Filter End) |
|---|---|---|
| 1 | US type blend | US type blend mentholated |
| 2 | US type blend | 100% DEER Menthol-Cyclodextrin |
| 3 | US type blend | 100% DEER EXPECT 331 |
| 4 | US type blend | 60% DEER Menthol-Cyclodextrin + 40% US type blend |
| 5 | US type blend | 50% DEER *Mentha arvensis* + 50% US type blend |
| 6 | US type blend | 50% DEER EXPECT 331 + 50% US type blend |
| 7 | US type blend | 50% DEER Menthol Cyclodextrin + 50% US type blend |
| 8 | US type blend | 50 DEER Menthol Cyclodextrin + 50% US type blend (with flavour on the adhesive) |
| 9 | US type blend | 50% DEER Menthol Cyclodextrin + 50% US type blend (strip to connect both segments) |

EXPECT 331 is a tobacco blend comprising tobacco dust, starch, xanthan gum, cocoa, liquorice and glycerol. The proportions of the components of EXPECT may be seen in Table 2.

TABLE 2

| Component | Proportion (%) |
|---|---|
| Tobacco dust | 75 |
| Starch | 16 |
| Xanthan Gum | 2.5 |
| Cocoa | 2.5 |
| Liquorice | 1.5 |
| Glycerol | 2.5 |

The above samples underwent a sensorial evaluation, all samples resulting in a noticeable change in sensorial characteristics upon smoking due to the flavourant of the first segment. Samples 2, 4, 7-9, containing DEER menthol cyclodextrin, had an increased fresh finish effect. Samples 7-9 included a vanilla flavourant mixed with the adhesive used on the wrappers, and also used a reduced amount of adhesive. These samples resulted in a reduced off-taste caused by the adhesive.

The invention claimed is:

1. A smoking article comprising a rod of smoking material that can be pyrolyzed and inhaled and which is wrapped in a wrapper, said rod having a first end which is devoid of a filter element and suitable only to be lit in use and an opposite second end which may or may not be adjacent to a filter element and suitable for placement in a smoker's mouth in use, said rod comprising at least two discrete smokable segments joined in substantially end-to-end abutment, the segment adjacent said second end comprising an encapsulated flavourant incorporated within the smoking material thereof, and the segment adjacent said first end being devoid of any encapsulated flavourant in the smoking material thereof.

2. A smoking article according to claim 1, wherein the rod of smoking material comprises only two segments.

3. A smoking article according to claim 1, wherein said segment adjacent said second end is the only segment of said smoking article containing encapsulated flavourant therein.

4. A smoking article according to claim 1, wherein said encapsulated flavourant is selected from the group consisting of menthol, cocoa, *Mentha arvensis*, vanillin, ethylvanillin, ethyl vanillin glycoside, ionone, damascenone, $C_9$ to $C_{12}$ lactones, or mixtures thereof.

5. A smoking article according to claim 1, wherein said flavourant is encapsulated in a polysaccharide, a starch, a cyclodextrin, or an adsorbent.

6. A smoking article according to claim 1, wherein an inert material is present on said encapsulated flavourant to reduce particulate matter delivered to the consumer during smoking of said smoking article.

7. A smoking article according to claim 6, wherein said inert material is a carbonate.

8. A smoking article according to claim 1, wherein said smoking material of said segment adjacent said second end comprises reconstituted tobacco material.

9. A smoking article according to claim 8, wherein said encapsulated flavourant is incorporated within said reconstituted tobacco material of said segment adjacent said second end.

10. A smoking article according to claim 8, wherein said reconstituted tobacco material constitutes 20-50% of the smoking material of said segment adjacent said second end.

11. A smoking article according to claim 8, wherein said reconstituted tobacco material comprises tobacco dust, said tobacco dust constituting 30-70% of said reconstituted tobacco material.

12. A smoking article according to claim 8, wherein said smoking material of said segment adjacent said second end is an extruded rod.

13. A smoking article according to claim 1, wherein said encapsulated flavourant is included in an amount of 200 to 50,000 parts per million.

14. A smoking article according to claim 1, wherein the length of each discrete segment is 10-90% of the total length of said rod of smoking material.

15. A smoking article according to claim 14, wherein the length of each discrete segment is 40-60% of the total length of said rod of smoking material.

16. A smoking article according to claim 1, wherein said smoking article comprises a filter element joined to said second end.

17. A smoking article according to claim 1, wherein each said discrete segment is individually circumscribed by a wrapper.

18. A smoking article according to claim 2, wherein the two discrete segments are joined by a wrapper.

19. A smoking article according to claim 18, wherein the wrapper contains indicia which indicates to the consumer the point at which the taste and aroma characteristics of said smoking article will be modified when being smoked.

20. A smoking article according to claim 19, wherein said wrapper is coloured.

21. A smoking article according to claim 16, wherein said filter element is joined to said segment adjacent said second end of the smoking article by a wrapper.

22. A smoking article according to claim 21, wherein said wrapper is a conventional cigarette wrapper, a tipping wrapper, a pretipping wrapper or a plugwrap.

23. A smoking article according to claim 1, having adhesive used to secure said wrapper, said adhesive comprising an encapsulated flavourant therein.

24. A method of making a smoking article according to claim 1, the method comprising incorporating an encapsulated flavourant within a component of a smoking material and forming the smoking material into a first segment, and joining the first segment in substantially end-to-end abutment to a second segment with a wrapper to form a rod of smoking material.

25. A method according to claim 24, wherein the encapsulated flavourant is incorporated within a reconstituted tobacco material.

26. A method according to claim 25, wherein the reconstituted tobacco material is produced by an extrusion process.

27. A method according to claim 24, wherein the encapsulated flavourant is encapsulated in a polysaccharide, a starch, a cyclodextrin or an adsorbent.

28. A method according to claim 24, wherein the rod of smoking material is joined to a filter element with a wrapper.

29. A method according to claim 28, wherein the first segment is joined to the filter element with a wrapper.

30. A method according to claim 29, wherein the second segment is joined to the first segment with a wrapper that circumscribes entirely the filter element and the first segment.

31. A method according to claim 24, wherein the second segment is joined to the first segment by a wrapper that only partially circumscribes each of the first and second segments.

32. A method according to claim 31, wherein the wrapper indicates to the consumer the point at which the taste and aroma characteristics of the smoking article will be modified when being smoked.

33. A method according to claim 32, wherein the wrapper is coloured.

34. A method according to claim 24, wherein the first and second segments are individually circumscribed with a wrapper.

35. A method according to claim 24, wherein an encapsulated flavourant is mixed with an adhesive, the adhesive being applied to the wrapper to secure the wrapper in position.

36. A smoking article according to claim 1 wherein said encapsulated flavourant is structured to be released during use only as the burning coal from said first end comes into contact with said encapsulated flavourant.

* * * * *